US009441601B2

(12) United States Patent
Bradfield et al.

(10) Patent No.: US 9,441,601 B2
(45) **Date of Patent: *Sep. 13, 2016**

(54) DUAL SYNCHRONIZED VEHICLE STARTER MOTORS

(71) Applicant: Remy Technologies LLC, Pendleton, IN (US)

(72) Inventors: Michael D. Bradfield, Anderson, IN (US); Attila Nagy, Fishers, IN (US)

(73) Assignee: REMY TECHNOLOGIES, LLC, Pendleton, IN (US)

( * ) Notice: Subject to any disclaimer, the term of this patent is extended or adjusted under 35 U.S.C. 154(b) by 145 days.

This patent is subject to a terminal disclaimer.

(21) Appl. No.: 14/305,115

(22) Filed: Jun. 16, 2014

(65) Prior Publication Data

US 2014/0290615 A1 Oct. 2, 2014

Related U.S. Application Data

(63) Continuation of application No. 13/341,556, filed on Dec. 30, 2011, now Pat. No. 8,776,753.

(51) Int. Cl.
*F02N 11/08* (2006.01)
*F02N 11/00* (2006.01)

(52) U.S. Cl.
CPC ..... *F02N 11/0851* (2013.01); *F02N 11/006* (2013.01); *Y10T 74/131* (2015.01)

(58) Field of Classification Search
CPC . F02N 11/0851; F02N 11/006; Y10T 74/131
USPC ..... 123/179.25, 179.28; 290/46, 47, 48, 290/38 R; 74/7 R; 701/113
See application file for complete search history.

(56) References Cited

U.S. PATENT DOCUMENTS

| | | | | |
|---|---|---|---|---|
| 2,115,671 | A * | 4/1938 | Pfister | F02N 11/006 290/38 A |
| 2,930,901 | A * | 3/1960 | Freeman | F02N 11/006 290/30 R |
| 3,443,114 | A | 5/1969 | Edwin | |
| 4,170,211 | A * | 10/1979 | Worthington | F02N 11/00 123/179.19 |
| 4,897,554 | A | 1/1990 | Uehara et al. | |
| 5,095,864 | A | 3/1992 | Bolenz et al. | |
| 6,694,938 | B2 | 2/2004 | Vilou | |
| 8,359,863 | B2 * | 1/2013 | Armiroli | F02B 11/006 123/179.1 |
| 8,479,698 | B2 * | 7/2013 | Wanner | F02B 11/006 123/179.25 |

(Continued)

FOREIGN PATENT DOCUMENTS

| | | | |
|---|---|---|---|
| CN | 201273245 | Y | 7/2009 |
| CN | 101910614 | A | 12/2010 |

(Continued)

*Primary Examiner* — Hai Huynh
(74) *Attorney, Agent, or Firm* — Maginot, Moore & Beck LLP

(57) ABSTRACT

A vehicle starter motor arrangement comprises a battery, a first vehicle starter motor including a first pinion and a second vehicle starter motor including a second pinion. The first vehicle starter motor is connected in series to the battery and the second vehicle starter motor is connected in series to the first vehicle starter motor. Accordingly, the battery, the first vehicle starter motor, and the second vehicle starter motor are all connected in series. The first pinion gear and the second pinion gear are configured to engage an engine ring gear when electrical current flows through the first vehicle starter motor and the second vehicle starter motor.

20 Claims, 2 Drawing Sheets

(56) References Cited

U.S. PATENT DOCUMENTS

| | | | | |
|---|---|---|---|---|
| 8,598,728 | B2 * | 12/2013 | Navetta | F02D 29/06 290/40 R |
| 8,661,834 | B2 * | 3/2014 | Tsuji | F02N 7/00 123/179.31 |
| 9,133,810 | B2 * | 9/2015 | Kees | F02N 11/006 |
| 2003/0140879 | A1 * | 7/2003 | Vilou | F02B 11/04 123/179.3 |
| 2007/0040383 | A1 * | 2/2007 | Mehl | F02N 11/04 290/36 R |
| 2008/0264374 | A1 * | 10/2008 | Harris | E02F 9/20 123/179.3 |
| 2008/0283005 | A1 * | 11/2008 | Kawada | F02N 11/006 123/90.15 |
| 2010/0033276 | A1 | 2/2010 | Niimi et al. | |
| 2010/0038961 | A1 | 2/2010 | Divito et al. | |
| 2011/0175357 | A1 * | 7/2011 | Navetta | F02D 29/06 290/47 |
| 2011/0202264 | A1 | 8/2011 | Sengebusch | |

FOREIGN PATENT DOCUMENTS

| | | | |
|---|---|---|---|
| CN | 102661224 | A | 9/2012 |
| DE | 19951597 | C1 | 3/2001 |
| JP | 09177643 | A | 7/1997 |

* cited by examiner

DUAL SYNCHRONIZED VEHICLE STARTER MOTORS

CROSS-REFERENCE TO RELATED APPLICATIONS

This application is a continuation of U.S. patent application Ser. No. 13/341,556, filed Dec. 30, 2011.

FIELD

This application relates to the field of starter motor assemblies, and more particularly, to starter motor assemblies for vehicles.

BACKGROUND

Starter motor assemblies are used to start vehicle engines, such as engines in heavy duty vehicles. The conventional starter motor assembly broadly includes an electric motor, a solenoid, and a drive mechanism.

The starter motor is placed in operation when a user closes an ignition switch on the vehicle and energizes the solenoid. Energization of the solenoid moves a solenoid shaft (also referred to herein as the "plunger") in an axial direction. Movement of the solenoid plunger closes electrical contacts, thereby delivering full power to the electric motor. Movement of the solenoid plunger also moves a pinion of the drive mechanism into engagement with the engine flywheel gear. The electric motor delivers torque to the pinion. The pinion, in turn, causes the flywheel to rotate, thereby cranking the vehicle engine.

Once the vehicle engine starts, the operator of the vehicle opens the ignition switch, de-energizing the solenoid assembly. As a result of this deenergization, the magnetic field that caused the plunger to move decreases and is overcome by a return spring, causing the plunger to return to its original position. As the plunger moves to its original position, the pinion is pulled away from the ring gear, and the vehicle engine operates free of the starter motor.

Many starter motors include features that facilitate engagement of the pinion with the vehicle ring gear. One example of such a feature is known as a "soft-start" arrangement. Soft-start arrangements generally allow some limited power to be provided to the electric motor before the pinion engages the ring gear. As a result, the electric motor and pinion provide a "soft start" torque which helps the pinion clear any abutment with the ring gear, thus encouraging the pinion teeth to fully mesh with the ring gear teeth.

Soft-start arrangements typically utilize two coils, i.e., a pull-in coil and a hold-in coil. Both the pull-in coil and the hold-in coil are initially energized when the ignition switch is turned on, allowing current to flow through both coils. The electric field created by energization of the two coils encourages the plunger of the solenoid assembly to move in the axial direction, thus moving the pinion toward engagement with the ring gear of the engine flywheel. The pinion is driven by the electric motor of the soft-start arrangement such that the electric motor provides rotational torque to the pinion.

The electric motor of the soft-start arrangement is in series with the pull-in coil. Thus, the resistance of the pull-in coil limits current flowing through the electric motor during the process of pinion engagement with the ring gear. Because only limited current flows through the electric motor, the torque provided by the electric motor and the associated pinion are also limited (relative to the normal cranking torque) during the process of pinion engagement with the ring gear. As the pinion moves toward engagement with the ring gear, it freely rotates. However, once the pinion is abutted with the ring gear, the rotational speed of the pinion is limited as frictional drag between the pinion and ring gear prevents rapid acceleration of the pinion. Thus, the pinion rotates into full mesh with the ring gear at a relatively slow rotational speed (relative to the normal cranking speed). This relatively slow rotational speed of the pinion allows the pinion to more easily mesh with the ring gear.

When the plunger is moved to the point where the plunger contact disc engages the electrical contacts, the pull-in coil is effectively short circuited, and full power is delivered to the electric motor. The hold-in coil then holds the plunger in place in order to maintain engagement of the pinion with the ring gear during engine cranking.

Starter motors with soft-start arrangements are generally very effective in starting vehicle engines. However, some minor issues with soft-start arrangements occasionally exist with certain situations. One situation where an issue may exist is a heavy-duty application when two starter motors with soft-start arrangements are used to crank a single engine. In this situation, the two starter motors are connected electrically in parallel across a 24V battery pack on the vehicle. This arrangement of two starter motors works quite well for actual starting of the engine. However, the two starter motors operate independent of each other, and do not always provide full cranking power at the same point in time. This time difference may be 0.25 seconds or larger. Because of this, a noise may be encountered as the first starter motor is fully engaged with the ring gear and cranking the engine while the second starter motor is still trying to engage the ring gear. Accordingly, it would be desirable to provide a dual starter motor arrangement that provides for reduced noise over existing dual starter motor arrangements. It would also be desirable if such a dual starter motor arrangement could be implemented with only limited additional costs than existing dual starter motor arrangements.

SUMMARY

In accordance with one embodiment of the disclosure, a vehicle starter motor arrangement comprises a first vehicle starter motor, and a second vehicle starter motor. The first vehicle starter motor includes a solenoid with at least one coil, an electric motor, a first terminal, a second terminal, and an output member. The second vehicle starter motor includes a solenoid with at least one coil, an electric motor, a first terminal, a second terminal, and an output member. The first terminal of the second vehicle starter motor is electrically connected to the second terminal of the first vehicle starter motor.

Pursuant to another embodiment of the disclosure, a vehicle starter motor arrangement comprises a first vehicle starter motor and a second vehicle starter motor. The first vehicle starter motor includes a first electric motor configured to drive a first output member. The second vehicle starter motor is electrically connected to the first vehicle starter motor. The second vehicle starter motor includes a second electric motor configured to drive a second output member.

In accordance with yet another embodiment of the disclosure, a method of starting a vehicle engine comprises energizing a first solenoid of a first vehicle starter motor, the first vehicle starter motor including a first output member. The method further comprises energizing a second solenoid of a second vehicle starter motor, the second vehicle starter motor including a second output member. In addition, the method comprises moving the first output member toward a cranking member of the vehicle engine, and moving the second output member toward the cranking member of the vehicle engine. Thereafter, the method comprises cranking the vehicle engine with the first vehicle starter motor or the second vehicle starter motor.

The above described features and advantages, as well as others, will become more readily apparent to those of ordinary skill in the art by reference to the following detailed description and accompanying drawings. While it would be desirable to provide a dual starter motor arrangement that provides one or more of these or other advantageous features, the teachings disclosed herein extend to those embodiments which fall within the scope of the appended claims, regardless of whether they accomplish one or more of the above-mentioned advantages.

DESCRIPTION

Figure 1:
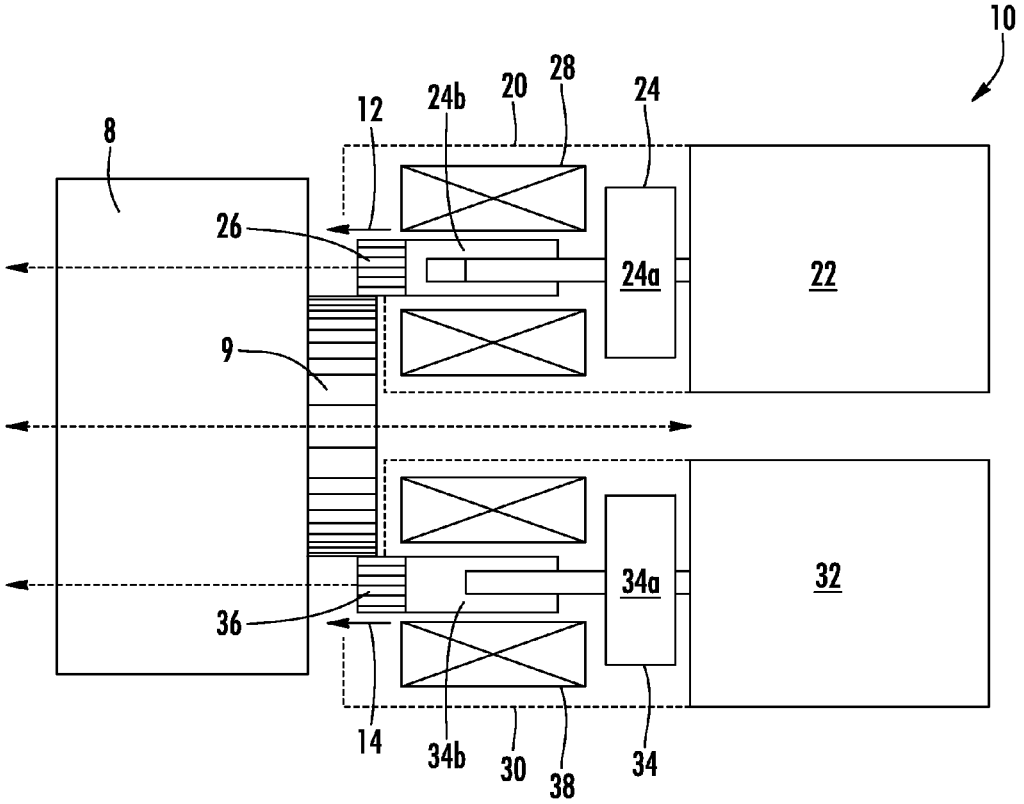
FIG. 1 shows a dual starter motor arrangement for a vehicle engine.
Figure 2:
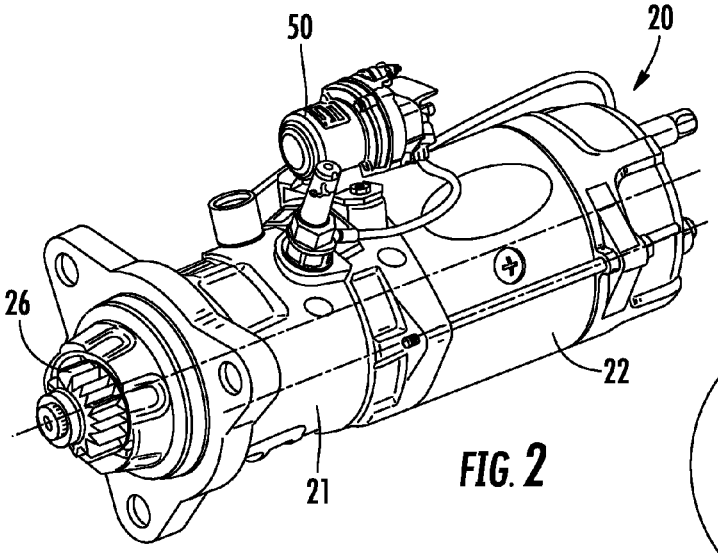
FIG. 2 shows a perspective view of one starter motor of the dual starter motor arrangement of FIG. 1.
Figure 3:
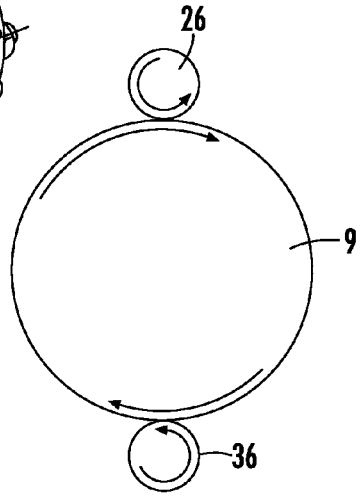
FIG. 3 shows the direction of rotation of a ring gear and starter motor pinions of the dual starter motor arrangement of FIG. 1.
Figure 4:
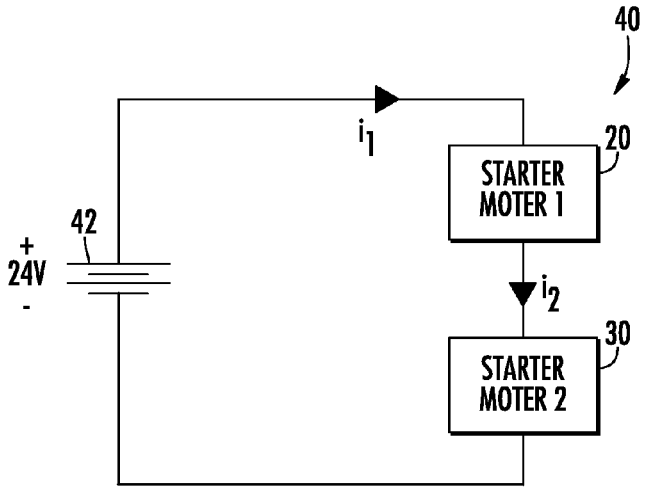
FIG. 4 shows a block diagram of a circuit arrangement for the dual starter motor arrangement of FIG. 1.
Figure 5:
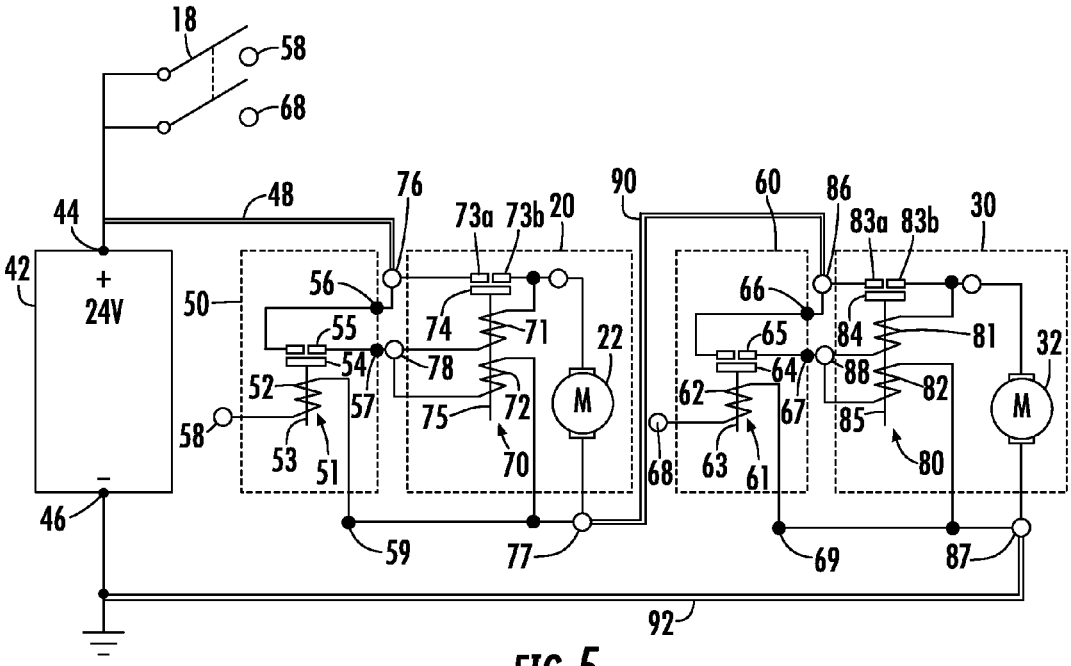
FIG. 5 shows a schematic for the dual starter motor arrangement of FIG. 1.

With reference to FIG. 1, an exemplary starter motor arrangement 10 for a vehicle is shown. The starter motor arrangement includes a first vehicle starter motor 20 and a second vehicle starter motor 30. The first vehicle starter motor 20 and second vehicle starter motor 30, are configured to engage a cranking member of a vehicle engine 8, such as ring gear 9, and crank the vehicle engine 8. The vehicle starter motors are electrically connected in series with a vehicle battery. In association with the discussion below, FIGS. 1-3 illustrate the mechanical arrangement of the vehicle starter motors 20 and 30. FIGS. 4 and 5 illustrate the electrical connections between the vehicle starter motors 20 and 30, which are also referred to herein as simply "starter motors".

As shown in FIG. 1, the first starter motor 20 includes an electric motor 22, a drive mechanism 24, an output member such as a pinion 26, and a solenoid assembly 28. The electric motor 22 is coupled to the drive mechanism 24 and is configured to transmit torque to the drive mechanism. The drive mechanism 24 includes a number of gears and related devices configured to transmit the torque from the electric motor 22 to the pinion 26 or other output member. For example, the drive mechanism may include a planetary gear system 24*a* and a telescoping pinion shaft 24*b*, with the pinion 26 provided on the end of the pinion shaft 24*b*. The solenoid assembly 28 includes a spool with coils wound around the spool. The coils include a pull-in coil and a hold-in coil. The pinion shaft 24*b* extends through the spool and serves as the solenoid plunger. Accordingly, the solenoid assembly 28 disclosed in the embodiment of FIG. 1 is coaxial with the electric motor 22. However, it will be recognized by those of ordinary skill in the art that, in other embodiments, the starter motor 20 may be provided as a dual-axis starter motor where the solenoid assembly 28 is not coaxial with the electric motor 22 and is coupled to the drive mechanism 24 by a shift lever.

FIG. 2 shows the starter 20 with the solenoid assembly 28 and drive mechanism 24 positioned within a housing 21. The electric motor 22 is coupled to one end of the housing 21 and the pinion 26 is slideably positioned at an opposite end of the housing 21. The housing 21 substantially encloses various components of the starter motor 20 and shields the components from debris. The housing 21 is typically comprised of a protective metal material, such as cast aluminum or steel.

With reference again to FIG. 1, the second starter motor 30 is similar or identical to the first starter motor 20 and includes an electric motor 32, a drive mechanism 34, a pinion 36 or other output member, and a solenoid assembly 38. The electric motor 32 is coupled to the drive mechanism 34 and is configured to transmit torque to the drive mechanism. The drive mechanism 34 includes a number of gears and related devices configured to transmit the torque from the electric motor 32 to the pinion 36. For example, the drive mechanism may include a planetary gear system 34*a* and a telescoping pinion shaft 34*b*, with the pinion 36 provided on the end of the pinion shaft 34*b*. The solenoid assembly 38 includes coils wound around a spool, including a hold-in coil and a pull-in coil. The coils that encircle the pinion shaft 34*b*, with the pinion shaft 34*b* serving as the plunger of the solenoid assembly 38. Accordingly, the solenoid assembly 38 disclosed in the embodiment of FIG. 1 is coaxial with the electric motor 32. Again, it will be recognized by those of ordinary skill in the art that the starter motor 30 may also be provided in other forms, such as a dual axis starter motor.

As indicated by arrow 12 in FIG. 1, when the solenoid assembly 28 of the first starter motor 20 is energized, the pinion shaft 24*b* and pinion 26 move in the axial direction toward the engine ring gear 9 of the vehicle engine 8. At the same time, the solenoid assembly 38 of the second starter motor 30 is energized, and the pinion shaft 34*b* and pinion 36 move in the axial direction toward the engine ring gear 9, as indicated by arrow 14. When the pinions 26 and 36 are moved into meshed engagement with the ring gear 9, the solenoid plunger is positioned to close electrical contacts which deliver full power to the electric motors 22 and 32. The electric motors 22, 32, deliver torque to the pinions 26, 36 via the drive mechanisms 24, 34. The pinions 26, 36, in turn, cause the flywheel to rotate, thereby cranking the vehicle engine. FIG. 3 illustrates an exemplary arrangement of the pinions 22, 32 relative to the ring gear 9, and the direction of rotation of the pinions 22, 32 and ring gear 9 during cranking of the vehicle engine 8.

FIGS. 4 and 5 show the starter motors 20 and 30 in the vehicle electrical system. With particular reference to FIG. 4, a block diagram of the vehicle electrical system 40 is shown with the first starter motor 20, the second starter motor 30, and the vehicle battery 42 in a series circuit. A jumper cable 90 electrically connects the first starter motor 20 to the second starter motor 30 in the series circuit. In the disclosed embodiment, the vehicle battery 42 is a 24V battery, and the electric motors 22 and 32 of the first and second starter motors 20 and 30 are 12V motors. With the two starter motors 20 and 30 connected in series, and accounting for a relatively low resistance in any cables in the circuit, the effective resistance across each motor is close to the designed for 12V. While a 24V battery and 12V motors are disclosed herein, it will be recognized that numerous different voltages and motor ratings are possible for the dual starter motor arrangement 10. For example, in at least one embodiment for use in locomotive applications, a 64V battery and two 32V motors are used in the starter motor arrangement 10.

As illustrated in FIG. 4, because of the series connection between the starter motors 20 and 30, the electrical current $i_1$ through the first starter motor 20 must be the same as the electric current $i_2$ through the second starter motor 30. Thus, if the electric current through one of the starter motors is limited, electrical current through the second starter motor will also be limited. In particular, if one starter motor 20 or 30 is operating with limited current because the solenoid plunger has yet to close the electrical contacts that allow full current flow to the associated electric motor, the current to the other starter motor 30 or 20 will be similarly limited. Accordingly, full electrical power from the battery 42 can only flow through both electric motors 22 and 32 after both pinions 26 and 36 are properly meshed into the ring gear and the associated contacts are closed. This completely synchronizes the starter motors 20 and 30, and eliminates the time delay and noise sometimes associated with dual starter motor arrangements.

With particular reference to FIG. 5, a more detailed schematic of the electrical components of the starter motor arrangement 10 is shown. The starter motor arrangement 10 includes the vehicle battery or battery pack 42, the first starter motor 20, the second starter motor 30, the jumper cable 90, a first magnetic switch 50, and a second magnetic switch 60.

The battery 42 includes a positive terminal 44 and a negative terminal 46. A "B+" cable 48 is coupled to the positive terminal 44. A ground cable 92 is coupled to the negative terminal 46 (which may also be referred to herein as a "ground terminal"). In the disclosed embodiment, the battery is a 24V battery, but it will be recognized that batteries of different voltages and ratings may be used in different applications.

The electrical components of the first starter motor 20 include an electric motor 22 and a solenoid assembly 70. The solenoid assembly 70 includes a pull-in coil 71 and a hold-in coil 72, stationary contacts 73*a* and 73*b*, and a plunger contact 74 provided on a plunger 75. The pull-in coil 71, hold-in coil 72 and contacts 73 and 74 are commonly found on solenoid assemblies for starter motors, and may be provided in various embodiments as will be recognized by those of ordinary skill in the art.

The first starter motor 20 also includes a battery terminal 76, a ground terminal 77, and a solenoid terminal 78. The battery terminal 76 is connected to the B+ cable 48, thus coupling the first starter motor 20 to the battery 42. Within the starter motor 20, the battery terminal 76 leads to the first stationary contact 73*a*. The solenoid terminal 78 leads to a node of both the pull-in coil 71 and the hold-in coil 72. The ground terminal 77 leads to an opposite node of the hold-in coil and the electric motor 22. A jumper cable 90 is also connected to the ground terminal 77. However, the jumper cable 90 does not connect the ground terminal 77 of the first starter motor to the negative terminal of the battery 42, but instead connects the ground terminal 77 to the second starter motor 30, as described below.

The jumper cable 90 connects the first starter motor 20 to the second starter motor 30. In particular, the jumper cable 90 extends between the ground terminal 77 of the first starter motor 20 and a battery terminal 86 of the second starter motor 30. Thus, the jumper cable connects the first starter motor 20 to the second starter motor 30 in a series connection. The jumper cable 90 may be provided by a copper wire or any of various other conductors offering relatively low losses.

The second starter motor 30 generally includes the same internal components and terminals as the first starter motor, and the components are generally arranged in the same manner. Accordingly, as illustrated in FIG. 5, the second starter motor 30 includes an electric motor 32 and a solenoid assembly 80. The solenoid assembly 80 includes a pull-in coil 81 and a hold-in coil 82, stationary contacts 83*a* and 83*b*, and a plunger contact 84 provided on a plunger 85. The second starter motor 30 also includes a battery terminal 86, a ground terminal 87, and a solenoid terminal 88. Unlike the ground terminal 77 of the first starter motor 20, the ground terminal 87 of the second starter motor 30 is connected to the ground terminal 46 of the battery 42 by a ground cable 92.

The first magnetic switch 50 is coupled to the first starter motor 20 and is configured to control the current flowing to the pull-in coil 71 and hold-in coil 72 on the solenoid assembly 70. The first magnetic switch 50 includes a solenoid assembly 51 including a coil 52, a plunger 53, plunger contact 54, and stationary contacts 55. The first magnetic switch also includes four terminals including a battery terminal 56, a solenoid terminal 57, an ignition switch terminal 58 and a ground terminal 59. The battery terminal 56 of the magnetic switch 50 is connected to the battery terminal 76 of the first starter motor 20. The solenoid terminal 57 of the magnetic switch 50 is connected to the solenoid terminal 78 of the first starter motor 20. The ignition switch terminal 58 is connected to an ignition switch 18 in the vehicle. The ignition switch 18 (which may also be referred to as a "customer switch" or a "key switch") is controlled by the operator of the vehicle, as will be recognized by those of ordinary skill in the art, by moving the ignition switch between an on an off position. In the embodiment of FIG. 5, the ignition switch 18 is represented by a double pole, single throw switch that is connected to both the first magnetic switch 50 and the second magnetic switch 60. Accordingly, both starter motors 20 and 30 are controlled by a single ignition switch 18, as discussed in further detail below. When the ignition switch 18 is moved to the on position, the ignition switch terminal 58 is coupled to a voltage source, such as the 24V source provided at the positive terminal 44 of the battery 42. The ground terminal 59 of the first magnetic switch 50 is connected to the ground terminal 77 of the first starter motor 20, not the ground terminal 46 of the battery 42.

The second magnetic switch 60 is coupled to the second starter motor 30 and is configured to control the current flowing to the pull-in coil 81 and hold-in coil 82 on the solenoid assembly 80. The second magnetic switch 60 generally includes the same internal components and terminals as the first magnetic switch 50, and the components are generally arranged in the same manner. Accordingly, as illustrated in FIG. 5, the second magnetic switch 60 includes a solenoid assembly 61 including a coil 62, a plunger 63, plunger contact 64, and stationary contacts 65. The second magnetic switch 60 also includes four terminals including a battery terminal 66, a solenoid terminal 67, an ignition switch terminal 68 and a ground terminal 69. The battery terminal 66 of the second magnetic switch 60 is connected to the battery terminal 86 of the second starter motor 30, and thus also connected to the ground terminal 77 of the first starter motor 20. The solenoid terminal 67 of the second magnetic switch 60 is connected to the solenoid terminal 88 of the second starter motor 30. The ignition switch terminal 68 is connected to the ignition switch 18, as discussed above.

Accordingly, when the ignition switch 18 is moved to the on position, the ignition switch terminal 68 is coupled to a voltage source, such as the 24V source provided at the positive terminal 44 of the battery 42. The ground terminal 69 of the second magnetic switch 60 is connected to the ground terminal 87 of the second starter motor 30, and thus also connected to the ground terminal 46 of the battery 42.

Operation of the dual starter motor arrangement is now described with reference to FIG. 5. When the operator of the vehicle turns the customer switch (e.g., the ignition switch 18) to the on position, the 24V battery voltage is applied to the ignition switch terminal 58 of the first magnetic switch 50 and the ignition switch terminal 68 of the second magnetic switch 60.

When the battery voltage applied to the ignition switch terminals 58 and 68, the second magnetic switch 60 closes first because the coil 62 in the second magnetic switch 60 is connected directly to ground via ground terminal 69. By contrast, the ground terminal 59 of the first magnetic switch 50 is connected to the battery terminal 66 of the second magnetic switch 60. Thus, the coil 52 in the first magnetic switch 50 does not have current flow until the second magnetic switch 60 closes and provides a path to ground.

Current flowing through the coil 62 in the second magnetic switch 60 creates a magnetic field that moves the plunger 63 toward the stationary contacts 65. When the plunger contact 64 engages the stationary contacts 65, the second magnetic switch 60 is closed, and a path to ground is provided for the coil 52 of the first magnetic switch 50. This allows current to flow through the coil 52, creating a magnetic field that moves the plunger 53. Plunger 53 moves until the plunger contacts 54 engage the stationary contacts 55, thus closing the first magnetic switch 50.

With both the first and second magnetic switches 50 closed, current flows through both the pull-in coils 71, 81 and the hold-in coils 72, 82 of both the first and second solenoid assemblies 70, 80. The current flowing through the coils 71, 72, 81, 82 creates a magnetic field that urges the plungers 75, 85 to move toward the stationary contacts 73, 83. Current flowing through the pull-in coils 71, 81 is also directed through the electric motors 22, 32 as soft start current. This soft start current is generally controlled by the resistance of the pull-in coils 71, 81 of the solenoid assemblies 70 and 80, limiting the torque the electric motors 22, 32 provide to the pinion. At this point, the electric motors 22, 32 behave independently of each other, as the general operation of one motor 22 is not dependent on the other motor 32 at this time, and vice-versa.

As the plungers 75, 85 move the pinions 26, 36 and the plunger contacts 74, 84, one of three possible results will occur. First, the pinions 26, 36 of both starter motors 20, 30 may mesh into the ring gear 9 nearly synchronous, with the plunger contacts 74, 84 engaging the stationary contacts 73, 83 nearly synchronous. Second, there may be a significant time delay between meshing of the pinion 26 of the first starter motor 20 with the ring gear 9 and meshing of the pinion 36 of the second starter motor 30 with the ring gear 9, or vice-versa (i.e., either pinion 26 or 36 could be first to engage the ring gear). Third, one or both starter motors 20, 30 could experience a click-no-crank ("CNC") event (i.e., one or both pinions 26, 36 fail to mesh with the ring gear).

In the first case where both the pinions 26, 36 mesh into the ring gear 9 in nearly synchronous fashion, the plunger contacts 74, 84 also engage the stationary contacts 73, 83 in nearly synchronous fashion. When the plunger contacts 74, 84 engage the stationary contacts 73, 83, the pull-in coils 72, 82 are short-circuited, and full power is delivered to the electric motors 22, 32. With high current flowing through the electric motors 22, 32, the electric motors 22, 32 provide an increased torque to the pinions 26, 36 that is sufficient to turn the ring gear 9 and crank the vehicle engine 8. Once engine start occurs, the operator turns the ignition switch to the off position. This reduces and eventually eliminates current flow in all solenoid coils 71, 72, 81, 82, causing the solenoid plungers 75, 85 to retract and open the motor contacts 73, 83. This stops the flow of current through the electric motors 22, 32 and ends the cranking process.

In the second case where there is a significant time delay between meshing of the first pinion 26 with the ring gear 9 and meshing of the second pinion 36 with the ring gear 9 (or vice-versa), the series connection between the starter motors 20 and 30 prevents high current from flowing through the electric motor 22 of the first starter motor 20 without also flowing flow through the electric motor 32 of the second starter motor 30. For example, consider a moment in time where the first pinion 26 has engaged the ring gear 9, while the second pinion 36 continues moving toward the ring gear 9 but has yet to engage the ring gear 9. In this situation, the plunger contact 84 has yet to engage the stationary contacts 83 to allow full current flow through the second starter motor. Because the starter motors are in series, the current flowing through the first starter motor 20 is limited to the current flowing through the second starter motor 30 (i.e., as shown in FIG. 4, $i_1=i_2$). Thus, even though the pull-in coil 71 of the first starter motor 20 is short-circuited by the connection of the plunger contact 74 and the stationary contacts 73, only limited current is delivered to the electric motor 22 at this time, since the current through the second starter motor remains limited, torque to the pinions is also limited, and no cranking occurs with either starter motor. However, once both contacts 54 and 64 are closed, high current flows simultaneously through both electric motors 22 and 32, and both starter motors 20, 30 begin cranking synchronously. Accordingly, the previously experienced undesirable time delay and resulting noise are eliminated.

Because of this second case where one motor meshes before the other and the related circuitry, the windings of the typical 12V hold-in coil may be modified from use in the dual starter motor arrangement disclosed herein. The reason for this is that the applied voltage for the starter motor engaged first is higher than what it would normally experience since the resistance of the other starter motor in this condition does not effectively cut the battery pack voltage in half. However, this is significantly less than 24V.

In the third case where one or both starter motors 20, 30 experience a CNC event, the overall crank of the starter motor arrangement 10 will behave as if there was only one starter motor experiencing the CNC event. In particular, high current will not flow to either electric motor 22 or 32, and there will only be a "click" sound when the pinion strikes the ring gear. The reason for this is the same as discussed in previously, that the series connection arrangement results in the amount of current flowing through one starter motor being limited to the amount of current flowing through the second starter motor. If high current cannot flow through the electric motor 22 of the first starter motor 20, high current cannot flow through the electric motor 32 of the second starter motor 30. Accordingly, no cranking sound is made since high current does not flow in either motor. In this case, the customer will typically move the ignition switch back to the off position, and then make another attempt to crank the vehicle engine by returning the ignition switch to the on potion, thus repeating the entire process.

As described above, operation of the starter motor arrangement involves moving the first pinion toward a ring gear of the vehicle engine while also moving the second pinion toward the ring gear of the vehicle engine. However, as will be apparent from the above disclosure, the cranking the vehicle engine with either the first starter motor or the second starter motor occurs only if both the first pinion and the second pinion move into meshed engagement with the ring gear of the vehicle engine. In other words, when the pinion from one first starter motor moves into meshed engagement with the ring gear, that starter motor does not crank the vehicle engine until the pinion from the other starter motor also moves into meshed engagement with the ring gear. In addition, if the pinion from one starter motor experiences a CNC event, the other starter motor will not crank the vehicle engine.

The foregoing detailed description of one or more embodiments of the dual starter motor arrangement has been presented herein by way of example only and not limitation. It will be recognized that there are advantages to certain individual features and functions described herein that may be obtained without incorporating other features and functions described herein. Moreover, it will be recognized that various alternatives, modifications, variations, or improvements of the above-disclosed embodiments and other features and functions, or alternatives thereof, may be desirably combined into many other different embodiments, systems or applications. Presently unforeseen or unanticipated alternatives, modifications, variations, or improvements therein may be subsequently made by those skilled in the art which are also intended to be encompassed by the appended claims. Therefore, the spirit and scope of any appended claims should not be limited to the description of the embodiments contained herein.

What is claimed is:

1. A vehicle starter motor arrangement comprising:

a first vehicle starter motor including a solenoid with at least one coil, an electric motor, a battery terminal, a ground terminal, and an output member; and a second vehicle starter motor including a solenoid with at least one coil, an electric motor, a battery terminal, a ground terminal, and an output member, the battery terminal of the second vehicle starter motor electrically connected to the ground terminal of the first vehicle starter motor.

2. The vehicle starter motor arrangement of claim 1 further comprising a battery, wherein the battery terminal of the first vehicle starter motor is electrically connected to the battery.

3. The vehicle starter motor arrangement of claim 2 wherein the battery is a 24V battery, the electric motor of the first vehicle starter motor is a 12V motor, and the electric motor of the second vehicle starter motor is a 12V motor.

4. The vehicle starter motor arrangement of claim 1 wherein the output member of the first vehicle starter motor is a pinion and the output member of the second vehicle starter motor is a pinion.

5. The vehicle starter motor arrangement of claim 1, the at least one coil of the first vehicle starter motor is electrically connected to the electric motor such that current to the electric motor is limited during movement of the output member of the first vehicle starter motor in an axial direction.

6. The vehicle starter motor arrangement of claim 1 wherein the ground terminal of the second vehicle starter motor is electrically connected to ground.

7. The vehicle starter motor arrangement of claim 1 wherein the at least one coil of the solenoid of the first vehicle starter motor is shorted when the output member of the first vehicle starter motor moves a predetermined distance, and wherein the at least one coil of the solenoid of the second vehicle starter motor is also shorted when the output member of the second vehicle starter motor moves a predetermined distance.

8. The vehicle starter motor arrangement of claim 1 further comprising a first magnetic switch configured to connect or disconnect the battery terminal and a solenoid terminal of the first vehicle starter motor, and a second magnetic switch configured to connect or disconnect the battery terminal and a solenoid terminal of the second vehicle starter motor.

9. The vehicle starter motor arrangement of claim 8 further comprising an ignition switch configured to control current flowing through the first magnetic switch and the second magnetic switch.

10. A vehicle starter motor arrangement comprising:

a first vehicle starter motor including a first electric motor configured to drive a first output member; and a second vehicle starter motor electrically connected in series to the first vehicle starter motor, the second vehicle starter motor including a second electric motor configured to drive a second output member.

11. The vehicle starter motor arrangement of claim 10 further comprising a battery electrically connected to the first vehicle starter motor.

12. The vehicle starter motor arrangement of claim 11 wherein the first output member is a first pinion gear and the second output member is a second pinion gear, and the first pinion gear and the second pinion gear are configured to move into meshed engagement with an engine ring gear when electric current flows through the first vehicle starter motor and the second vehicle starter motor.

13. The vehicle starter motor of claim 11, the battery including a positive terminal and a negative terminal, the first vehicle starter motor further including a first solenoid, a first battery terminal, and a first ground terminal, and the second vehicle starter motor further including a second solenoid, a second battery terminal, and a second ground terminal, wherein the first battery terminal is electrically connected to the positive terminal, the first ground terminal is electrically connected to the second battery terminal, and the second ground terminal is electrically connected to the negative terminal.

14. The vehicle starter motor arrangement of claim 10, the first vehicle starter motor further including at least one solenoid, a solenoid terminal, a positive terminal, and a ground terminal;

the second vehicle starter motor further including at least one solenoid, a solenoid terminal, a positive terminal, and a ground terminal;

the vehicle starter motor arrangement further comprising a first switch configured to connect or disconnect the solenoid terminal and the positive terminal of the first vehicle starter motor, and the vehicle starter motor arrangement further comprising a second switch configured to connect or disconnect the solenoid terminal and the positive terminal of the second vehicle starter motor.

15. The vehicle starter motor of claim 14, wherein the solenoid terminal of the first vehicle starter motor is electrically connected to a pull-in coil and a hold-in coil of a solenoid of the first vehicle starter motor, and wherein the solenoid terminal of the second vehicle starter motor is electrically connected to a pull-in coil and a hold-in coil of a solenoid of the second vehicle starter motor.

16. A method of starting a vehicle engine comprising:

energizing a first solenoid of a first vehicle starter motor, the first vehicle starter motor including a first output member;

energizing a second solenoid of a second vehicle starter motor connected in series with the first vehicle starter motor, the second vehicle starter motor including a second output member;

moving the first output member toward a cranking member of the vehicle engine;

moving the second output member toward the cranking member of the vehicle engine; and cranking the vehicle engine with the first vehicle starter motor or the second vehicle starter motor.

17. The method of claim 16 wherein energizing the first solenoid occurs before energizing the second solenoid.

18. The method of claim 16 wherein the cranking member is a ring gear, the first output member is a first pinion, and the second output member is a second pinion.

19. The method of claim 18 wherein cranking the vehicle engine comprises cranking the vehicle engine with the first vehicle starter motor and the second vehicle starter motor if both the first pinion and the second pinion move into meshed engagement with the ring gear of the vehicle engine.

20. The method of claim 16 wherein the vehicle engine is cranked only if both the first output member and the second output member move into engagement with the cranking member of the vehicle engine.

* * * * *